US010126051B2

(12) United States Patent
Goldstein

(10) Patent No.: US 10,126,051 B2
(45) Date of Patent: Nov. 13, 2018

(54) METHOD FOR DRYING OF A COATING AND RELATED DEVICE

(71) Applicant: Michael D. Goldstein, Herzelia (IL)

(72) Inventor: Michael D. Goldstein, Herzelia (IL)

(73) Assignees: Eran Inbar, Tel-Aviv (IL); Michael D. Goldstein, Herzelia (IL)

( * ) Notice: Subject to any disclaimer, the term of this patent is extended or adjusted under 35 U.S.C. 154(b) by 570 days.

(21) Appl. No.: 14/461,457

(22) Filed: Aug. 18, 2014

(65) Prior Publication Data

US 2015/0047217 A1 Feb. 19, 2015

Related U.S. Application Data

(60) Provisional application No. 61/867,075, filed on Aug. 18, 2013.

(51) Int. Cl.
*F26B 3/30* (2006.01)

(52) U.S. Cl.
CPC ..... *F26B 3/30* (2013.01)

(58) Field of Classification Search
CPC ..... F26B 3/30; F26B 3/347
See application file for complete search history.

(56) References Cited

U.S. PATENT DOCUMENTS 5,435,994 A 7/1995 Valenty
7,162,811 B2 1/2007 Delaney
2008/0311309 A1* 12/2008 Daiss ..... B05D 3/0486 427/508
2013/0196075 A1* 8/2013 Konradi ..... C09D 4/00 427/496
2016/0067164 A1* 3/2016 Valia ..... A61Q 3/02 424/61

FOREIGN PATENT DOCUMENTS

GB 1375247 A * 11/1974 ..... B05D 3/029
JP 10109062 4/1998
KR 20110094730 8/2011

OTHER PUBLICATIONS

Barbara et al., (2007) Structure and dynamics of conjugated polymers in liquid crystalline solvents. Annu Rev Phys Chem 58: 565-84.
Link et al., (2006) Orthogonal orientations for solvation of polymer molecules in smectic solvents. Phys Rev Lett 96(1): 017801.
Miller et al., (2009) Induction heating of FeCo nanoparticles for rapid rf curing of epoxy composites. J Appl Phys 105: 07E714.
(Continued)

*Primary Examiner* — Jessica Yuen
(74) *Attorney, Agent, or Firm* — The Roy Gross Law Firm, LLC; Ray Gross

(57) ABSTRACT

A method for drying a coating applied to a substrate, wherein the coating comprises at least one volatile organic solvent (VOS), is provided. The method comprises a step of irradiating the coating by an electromagnetic radiation at a power P and within a defined spectrum, wherein the defined spectrum corresponds to an absorption peak of the volatile organic solvent.

10 Claims, 8 Drawing Sheets

(56) References Cited

OTHER PUBLICATIONS

Sielser (1977) Polymer-solvent interaction: The IR-dichroic behaviour of DMF residues in drawn films of polyacrylonitrile. Colloid and Polymer Science 255(4): 321-326.
Boston Electronics Corporation. NEW Light-Emitting Diodes for 1.9 to 7 mm. LED34SC and LED 55SC. Retrieved from the internet on Jul. 23, 2013 (http://boselec.com/products/irled.html).
Spectrogon: optical filters, coatings, gratings. BBP-5500-6000 nm Ø25.4x10. mm. Retrieved from the internet on Aug. 11, 2014 (http://www.spectrogon.com/wpcontent/uploads/spectrogon/BBP-5500-6000-nm.pdf).

* cited by examiner

METHOD FOR DRYING OF A COATING AND RELATED DEVICE

FIELD OF THE INVENTION

The invention relates to methods and device for drying a coating such as paint, lacquer or varnish.

BACKGROUND OF THE INVENTION

Coatings may be applied to surfaces of substrates in the form of liquid, paste or powder products, by various methods and equipment, in layers, forming adherent films on the surface of the substrate. Film formation can occur physically or chemically. Physical film formation from liquid coating (wet coating) is known as drying. Drying is typically associated with evaporation of organic solvents or water. Chemical film formation proceeds by chemical reaction between the components of the coating, wherein such reaction can be initiated by energy (heat or radiation) after application of the coating. Physical and chemical film formations are often combined. In such coatings solvent evaporation is followed by film curing (cross-linking of polymer chains).

In the process of drying of coatings, heat is usually supplied to evaporate the coating solvents. The elevated temperatures may also induce chemical drying thereby facilitating a continuous film formation, for example by coalescence of resin particles or by thermally-induced cross-linking of a polymer, comprised in the coating compositions. Heat may be supplied through convection by hot air that is blown on the coated surface. Alternatively or additionally, heat may be supplied through electromagnetic radiation, such as infrared or microwave radiation, wherein the electromagnetic radiation is absorbed by the irradiated substance and/or the coating. Infrared heaters, which can supply large amounts of energy in a limited space and over short periods of time, are, however, rarely used due to their high operating costs and safety concerns, when utilized for evaporation of organic solvents. Even when employing radiation for heating, some forced air displacement is usually needed to carry off the evaporated solvent.

J.P. Patent Application No. 10109062 is directed to a drying method of a coating film, applied from an organic solvent system or a water system, wherein it is the method of irradiating with and carrying out stoving of the near infrared and this near infrared is what is irradiated from a light source which has the spectral distribution which has maximum strength in wavelength of 0.8-1.2 micrometers, and strength decreases to 40% or less of maximum strength on wavelength of not less than 2.0 micrometers.

KR Patent Application No. 20110094730 is directed to a manicure dryer, provided to rapidly dry manicure applied on nails by generating ultrasonic wave and ultraviolet ray, wherein the upper body of the dryer is equipped with an infrared generator, and wherein the infrared generator dries manicure in a short time by evenly emitting heat to the manicure.

The process of drying a nail polish applied to a living tissue cannot afford high temperatures used for drying of coated articles. Thus, the drying should be made effective by alternative methods, such as, for example, high rate air flow or application of photo-sensitive coatings. Several devices have been developed to expedite the nail polish drying process.

U.S. Pat. No. 7,162,811 discloses a method for drying polish applied to the nails of an extremity, the method comprising: applying polish to the nails of an extremity; blowing warm air at a temperature of eighty five degrees Fahrenheit onto the nails for four minutes; then blowing cold air at a temperature of thirty five degrees Fahrenheit onto the nails for two minutes; and then blowing warm air at a temperature of eighty-five degrees Fahrenheit onto the nails for a period of fifteen seconds.

Various photo-curable nail polish formulations have been developed. U.S. Pat. No. 5,435,994 is directed to a photo-reactive coating for application over and for binding with nail polish upon exposure to ultraviolet radiation, comprising: (a) a base resin consisting of nitrocellulose; (b) a photo-reactive monomer selected from the group consisting of methacrylates, dimethacrylates, and mixtures thereof; (c) a photoinitiator consisting of benzyl diketal; and (d) an inhibitor to polymerization.

The foregoing examples of the related art and limitations related therewith are intended to be illustrative and not exclusive. Other limitations of the related art will become apparent to those of skill in the art upon a reading of the specification and a study of the figures.

The main ingredients of wet coating are a film-former, capable of forming a film on a surface of a substrate following application of the coating, and a solvent, required to disperse the film-former and to allow its application to the substrate, wherein the solvent is usually evaporated after the coating is applied. Solvents are typically characterized by a high vapor pressure, for allowing evaporation of the solvent at relatively low temperatures. Evaporation may be accelerated by removing the solvent vapor from above the surface of the coated substrate, thereby reducing the solvent's partial pressure in the immediate surrounding atmosphere of the surface. Evaporation may further be accelerated by increasing the temperature of the coating, thereby elevating the solvent's vapor pressure. Often, a combination of both heating and airing the coated surface are applied.

Hot-air type drying devices for the purpose of drying under heating may require high temperature of hot air and a large quantity of air drift at a high flow speed, since heat is transmitted through convection. This means that the surface of a substance to be dried is subject to high temperatures for a long period of time and only the surface portion is over-dried due to rapid drift of air, thereby preventing the underlying layers from being uniformly heated and dried. As a result, a problem may arise in the frequent occurrence of deformation such as a wrinkled coating or a coating in a form of waves, degeneration, dis-coloration, etc. Moreover, when heat is applied, the solvent, the film former and in many cases the coated substrate itself, are all heated to substantially the same temperature, as the coating and the substrate, at least within the layers thereof adjacent to the coated surface, are substantially in thermal equilibrium. In most cases, heating the mass of the coating together with at least a part of the mass of the coated substrate for the sake of heating just the solvent imposes low energetic efficiency on the process.

Thus, there exists an unmet need in the art for a coating drying technique, which would allow selective heating of a solvent in a coating and therefore provide fast and uniform evaporation of the solvent, allowing an effective drying of the coating.

SUMMARY OF THE INVENTION

The method and the device of the present invention allow specific heating of the solvents of the coating. The specific heating is effected by a step of irradiating a coating with electromagnetic radiation of defined spectrum, wherein the radiation spectrum corresponds to an absorption band of the coating solvent. When the electromagnetic radiation is selectively absorbed by the solvents present in the coating, the solvents' temperature increases, facilitating solvent's evaporation and the subsequent drying of the coating. According to an aspect of some embodiments, the method allows evaporating the solvent such that the solvent is not in thermal equilibrium with other ingredients of the coating, whereas solvent molecules are selectively heated, thereby being hotter, on the average, than other molecules in the coating. In some embodiments the solvent is not in thermal equilibrium with the substrate being coated, the solvent being, on the average, hotter. According to an aspect of some embodiments, evaporation of solvent molecules from the surface of the coating is tremendously increased, compared to prior art techniques. Consequently, the time for sufficient evaporation to allow curing is dictated by the rate of solvent molecules appearing on the surface, namely the diffusion rate of solvent molecules within the bulk of the coating. Employing methods described herein according to some embodiments may thus allow using solvents of relatively low volatility without sacrificing curing time, compared to using solvents of high volatility. Thus, according to some embodiments, methods described herein may contribute significantly to safety and environment-friendliness of coating processes in the industry.

In addition to the exemplary aspects and embodiments described above, further aspects and embodiments will become apparent by reference to the figures and by study of the following detailed description.

BRIEF DESCRIPTION OF THE FIGURES

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures are not to scale.

In the drawings.

DETAILED DESCRIPTION OF SOME EMBODIMENTS

Figure 1:
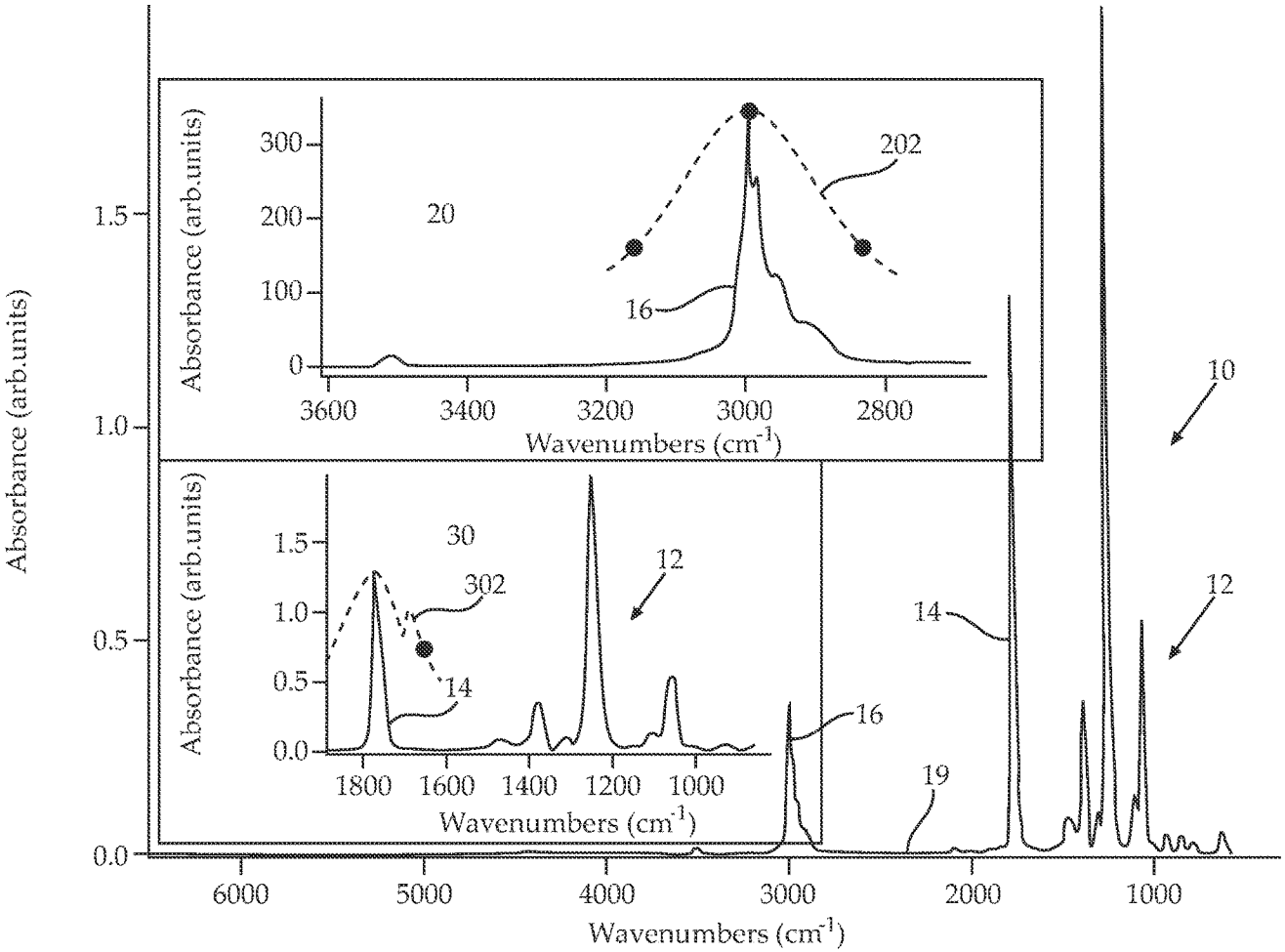
FIG. 1 illustrates an IR absorbance spectrum of ethyl acetate.

The present invention is directed to a coating drying method and device, wherein the drying is assisted by a specific absorption of electromagnetic radiation by selected constituents of the coating.

Coatings are usually applied to a substrate to improve or to change surface properties of the substrate, such as appearance, adhesion, wettability, corrosion resistance, wear resistance, and scratch resistance or to alter surface functional properties. Liquid coating (wet coating) is a coating comprising a liquid solvent, such as water or an organic solvent. Mixtures of solvents are often used for control of solvency and evaporation. Application of a liquid coating usually requires a drying step, in order to evaporate the solvent and to allow a coating film formation, wherein the film formation proceeds physically or chemically. Physical drying takes place mainly for coatings with high molecular mass polymer binders such as cellulose nitrate, cellulose esters, chlorinated rubber, vinyl resins, polyacrylates, styrene copolymers, thermoplastic polyesters and polyamide and polyolefin copolymers. Drying step is sometimes required several times during the coating process. For example, in automotive and aerospace painting, application of multiple coating layers is required, while some layers can be applied to dry surface only. Automotive coating is a complex, multistage process and drying is often required following each step.

A typical coating drying procedure may be ineffective due to several reasons. When heat is applied to the coated surface, e.g. by convection heating or by a wide spectrum radiation (such as from a black body radiating onto the surface), it is practically impossible to limit and direct the heating exclusively to the solvent. In other words, the entire mass of the coating material, together with portions of the coated substrate must be heated as well. The total energy required to achieve a desired temperature using such heating may sometimes be orders of magnitude greater than the energy required to heat just the solvent to the same temperature. When the coated objects that require drying are large and massive—e.g. vehicle parts and the like—the total energy required for heating is substantial in absolute terms, whereas effective heating directed mostly or even exclusively to the solvent may elevate process effectiveness.

In some applications of coating, heating is not an option at all. In some cases—e.g. when treating fingernails—the coated object may not be heated or may be heated very modestly. As a consequence drying time may prolong resulting in inefficient use of material resources as well as inefficient use of time.

An efficient drying process is therefore, such that thermal energy is selectively transferred to the solvents of the coating and is selectively absorbed by these solvents.

Materials are known to absorb electromagnetic radiation and to exhibit a complex absorption spectrum as a function of the radiation wavelength (or radiation frequency). Often, such an absorption spectrum constitutes spectral portions of relatively low absorption, referred to as background, and other spectral portions, in which the absorption is far greater than in the background, referred to as peaks. Such peaks of absorption are usually associated with a correspondence, a match or equality between the photonic energy of the radiation and energy levels of electronic or mechanical degrees of freedom of atoms or molecules in the material being irradiated.

For example, many materials exhibit peaks of absorption when the radiation wavelength corresponds to an energy level of a vibrational degree of freedom of the irradiated material or of a constituent thereof, for example to an energy level of a mutual vibration between the two atoms of a molecule.

Thus, when a material is irradiated at a wavelength that selectively corresponds to an absorption peak of a particular constituent thereof, radiation energy may be efficiently transferred to that particular constituent that absorbs the radiation, and may further selectively heat up that particular constituent.

Absorption peaks of organic molecules usually correspond to radiation wavelengths lying in the infrared spectrum. Infrared radiation is thus absorbed by organic molecules and converted into energy of molecular vibration. Typically, the coating solvents are selected from volatile organic solvents, such as, but not limited to, alcohols, esters, ketones, aldehydes, ethers and combinations thereof. Some specific solvents comprise alkyl acetate esters, for example ethyl acetate and butyl acetates, which are particularly preferred solvents in the nail polish compositions. Esters are characterized by intense sharp band in the frequency range of about 1750-1715 $cm^{-1}$, which is assigned to C═O bond vibration. However, this peak changes depending on the functional groups attached to the carbonyl. For example, the carbonyl stretch C═O of aliphatic esters appears from 1750-1735 $cm^{-1}$; while that of α, β-unsaturated esters appears from 1730-1715 $cm^{-1}$.

An aspect of some embodiments of the method may be exemplified as follows. Nail polish application, performed either at home or at a beauty salon, may employ three or even four different layers of coating. Each layer, after application, is allowed to air dry, making this process time consuming both for the manicurist and the person who is subjected to the nail polish application. Application of each subsequent layer must be preceded by a waiting period, allowing at least partial drying of the applied layer, wherein the waiting period after the application of the final layer, may take as long as about an hour in order to allow the applied coatings to dry completely. During the waiting period it is suggested to refrain from tasks that might cause damage to the applied nail polish, making the whole nail polish application process ineffective.

The basic components of nail lacquer are film formers and solvents. The nail lacquer composition may further include a secondary resin, a plasticizer, a suspending agent and a color pigment.

The film former, such as nitrocellulose, allows formation of a continuous and uniform coating on the nail. Nitrocellulose is generally used because it is particularly tough and wear resistant. Additional film formers that can be used in nail lacquer compositions include acrylic acid esters such as methyl, ethyl and butylmethacrylates. The nail lacquer compositions generally include 5 to 55% by weight of the film former. Preferred nail lacquer compositions contain at least one nitrocellulose film former.

The solvent is required to dissolve the film former, to allow the formation of a homogeneous mixture of ingredients and to stabilize the viscosity of the lacquer. Solvent may comprise 10 to 60% by weight of the nail lacquer composition. Generally a mixture of high and low vapor pressure solvents is used to achieve a rapid drying time combined with easy even application. Suitable solvents include organic esters such as ethyl acetate and butyl acetate, ketones, such as acetone, short chain alcohols, such as diacetone alcohol and isopropyl alcohol, and aromatic solvents, such as toluene.

A non-limiting example of a nail lacquer composition may include 13% by weight of nitrocellulose film former; 9% by weight of sulphonamide-formaldehyde; 7% by weight of dibutylphtalate; 27% by weight of butyl acetate; 23% by weight of ethyl acetate; 12% by weight of toluene; 9%—additional ingredients. Other solvent materials comprise ketones such as methyl ethyl ketone, methyl isobutyl ketone, acetone and the like. Additional solvents used in coatings include alcohols, such as isopropyl alcohol, or aromatic solvents, such as xylene, toluene and the like.

FIG. 1 illustrates an IR absorbance spectrum of ethyl acetate as a function of wavenumber. A main graph 10 illustrates the absorption spectrum over a wide range from about 6500 cm-1 to about 500 cm-1, corresponding to a wavelength range from about 1540 nm to about 20,000 nm, respectively, thereby substantially covering the spectral ranges commonly known as Short wavelength IR (SWIR, 1.4-3 μm), Mid wavelength IR (MWIR, 3-8 μm) and Long wavelength IR (LWIR, 8-15 μm). Graph 10 illustrates a first group 12 of three absorption peaks spanning the range between about 1600 cm−1 to 1000 cm−1, an absorption peak 14 attributed to the C═O bond stretch at 1752 cm−1, and an absorption peak 16 at about 2981 cm−1 attributed to a C—H bond stretch. A top insert graph 20 illustrates absorption peak 16 in detail. A bottom insert graph 30 depicts absorption peaks 12 and 14 over a range of about 1800 cm−1 to 1000 cm−1, in detail. A first background portion 18 of the absorption graph spans the range from about 6500 cm−1 to about 3200 cm−1, and a second background portion 19 is located in the spectral range between absorption peak 16 and absorption peak 14, namely between about 2800 cm−1 and 1800 cm−1. Both first background portion and second background portion are relatively flat, having very small variation around an absorption value of about 10%. The average absorption over the entire spectrum is about 15%. In ethyl acetate, the peak absorption of absorption peak 14 is about five times greater than the average absorption of the background, and the peak absorption at absorption peak 16 is about two-three times greater than the average absorption of the spectrum.

Figure 2:
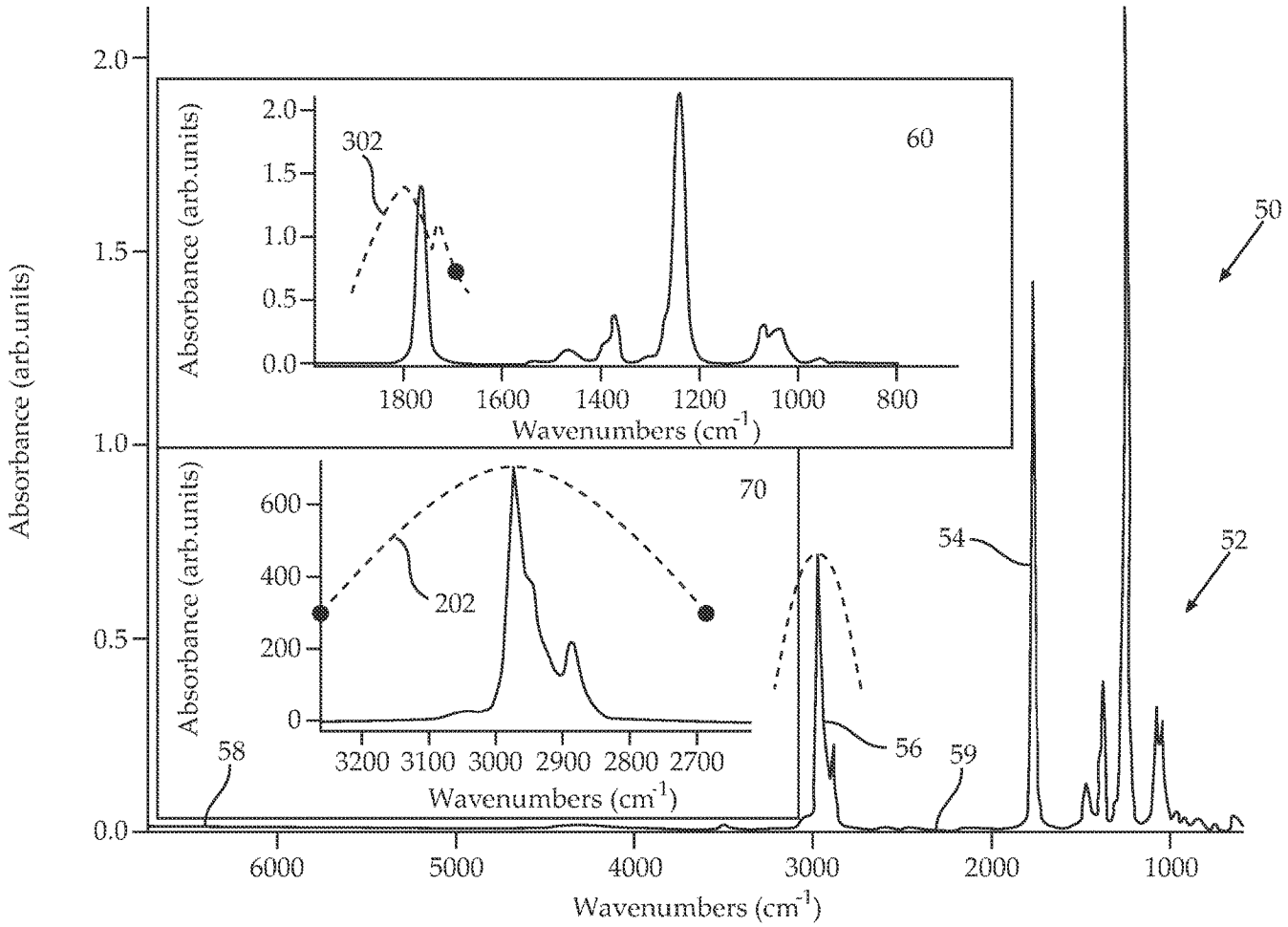
FIG. 2 illustrates an IR absorbance spectrum of butyl acetate.

FIG. 2 illustrates an IR absorbance spectrum of butyl acetate as a function of wavenumber, FIG. 2 is constructed similarly to FIG. 1, having a main graph 50 showing absorption peaks 52, 54 and 56, and background portions 58 and 59, and a top insert 60 and a bottom insert 70, illustrating the absorption peaks of the main graph in greater detail. Absorption peak 54 attributed to the C═O bond stretch is at 1745 cm−1.

Figure 3:
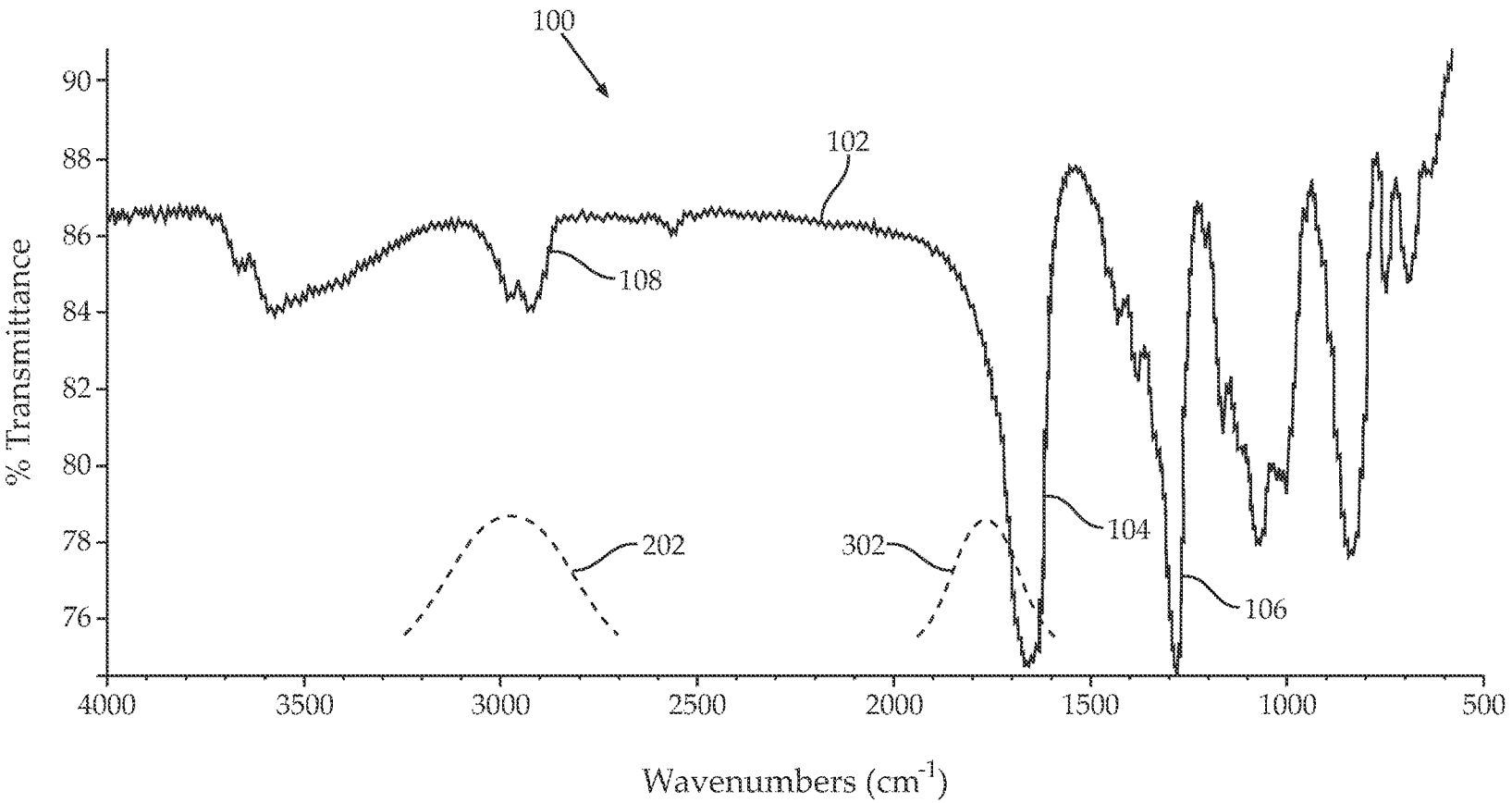
FIG. 3 illustrates an IR transmittance spectrum of nitrocellulose.

FIG. 3 illustrates a transmission spectrum 100 of nitrocellulose. Spectrum 100 shows several absorption peaks in the measured spectral range, extending relative to a background portion 102 of the spectrum, which spans between about 3200 cm−1 and 2100 cm−1. The most intense absorption peaks designated 104 and 106, are at about 1300 cm−1 and about 1670 cm−1, respectively. According to graph 100, peak absorption at absorption peaks 104 and 104 is about 1.5 the average absorption of the spectrum. A relatively shallow absorption peak 108 has a peak absorption at about 2950 cm−1, indicating less than 50% higher absorption than the average absorption of the spectrum Thus, according to an aspect of some embodiments, heat is supplied to the solvents such as ethyl acetate or butyl acetate by concentrating the spectral range of electromagnetic radiation around an absorption peak of the solvents. For comparison, heating the coating according to prior art, e.g. by radiating the substrate using black body radiation in the IR range, is not selective, because such black body radiation is relatively uniform over the spectral range of the graphs above. Heat generated by such radiation is therefore absorbed by the constituents of the coating depending on the average absorption of each constituent over the spectral range employed for radiation. Since the average absorption of nitrocellulose is not smaller and may even be higher than the average absorption of the solvent, nitrocellulose is heated up not less, and even more, than the solvent. Radiating the coating according to embodiments of the method described herein, concentrates a pre-selected percentage of the total radiated power in a spectral range of an absorption peak of the solvent, thereby effectively increasing the rate of selective heating of solvent molecules. According to some embodiments, the percentage of power which is selected to be concentrated over the spectral range of an absorption peak of the solvent is sufficient to induce a thermal imbalance between molecules of the solvent in the coating and molecules of the film former or of other constituents of the coating, thereby further increasing the rate of evaporation of the solvent.

Figure 4A:
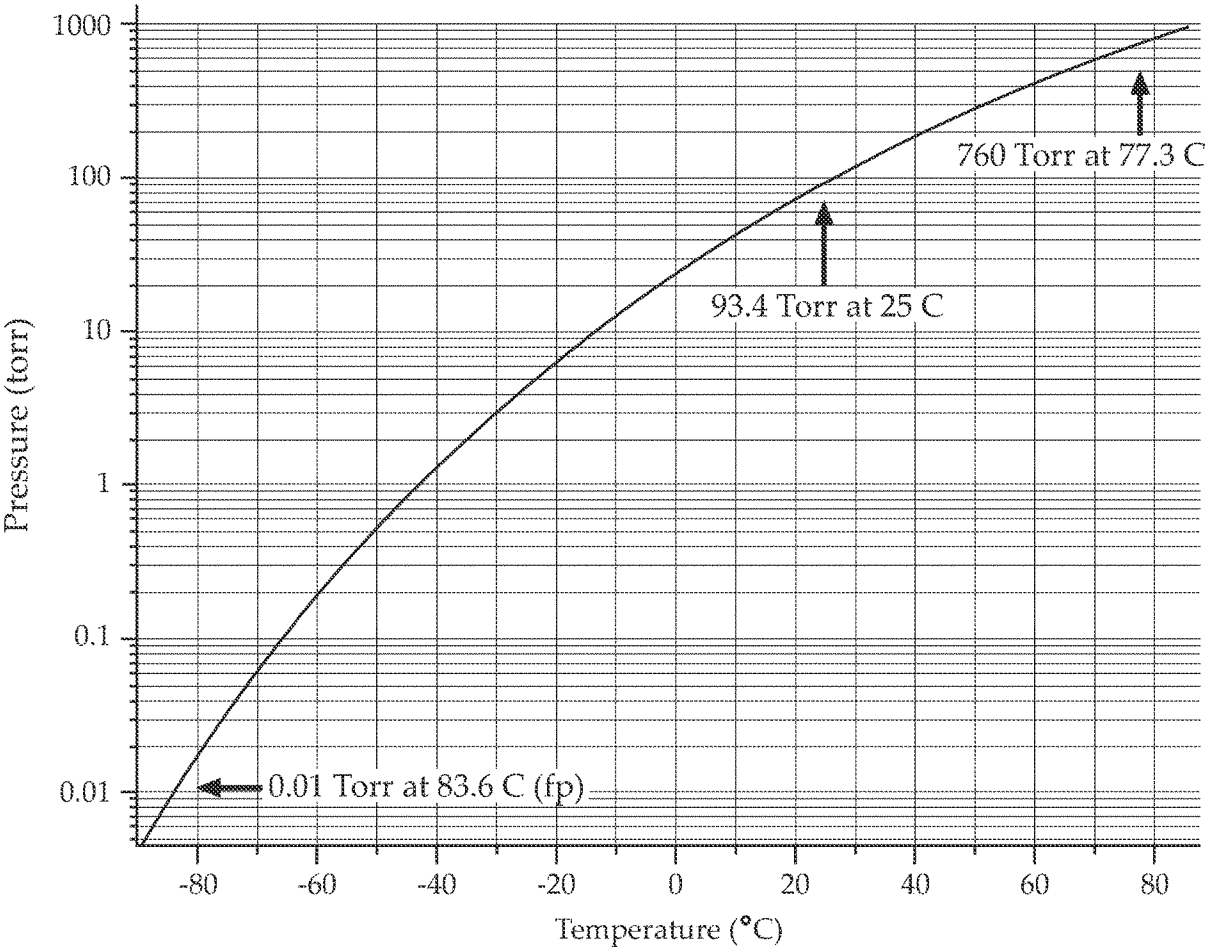
FIG. 4A illustrates the dependency of vapor pressure on temperature for ethyl acetate.
Figure 4B:
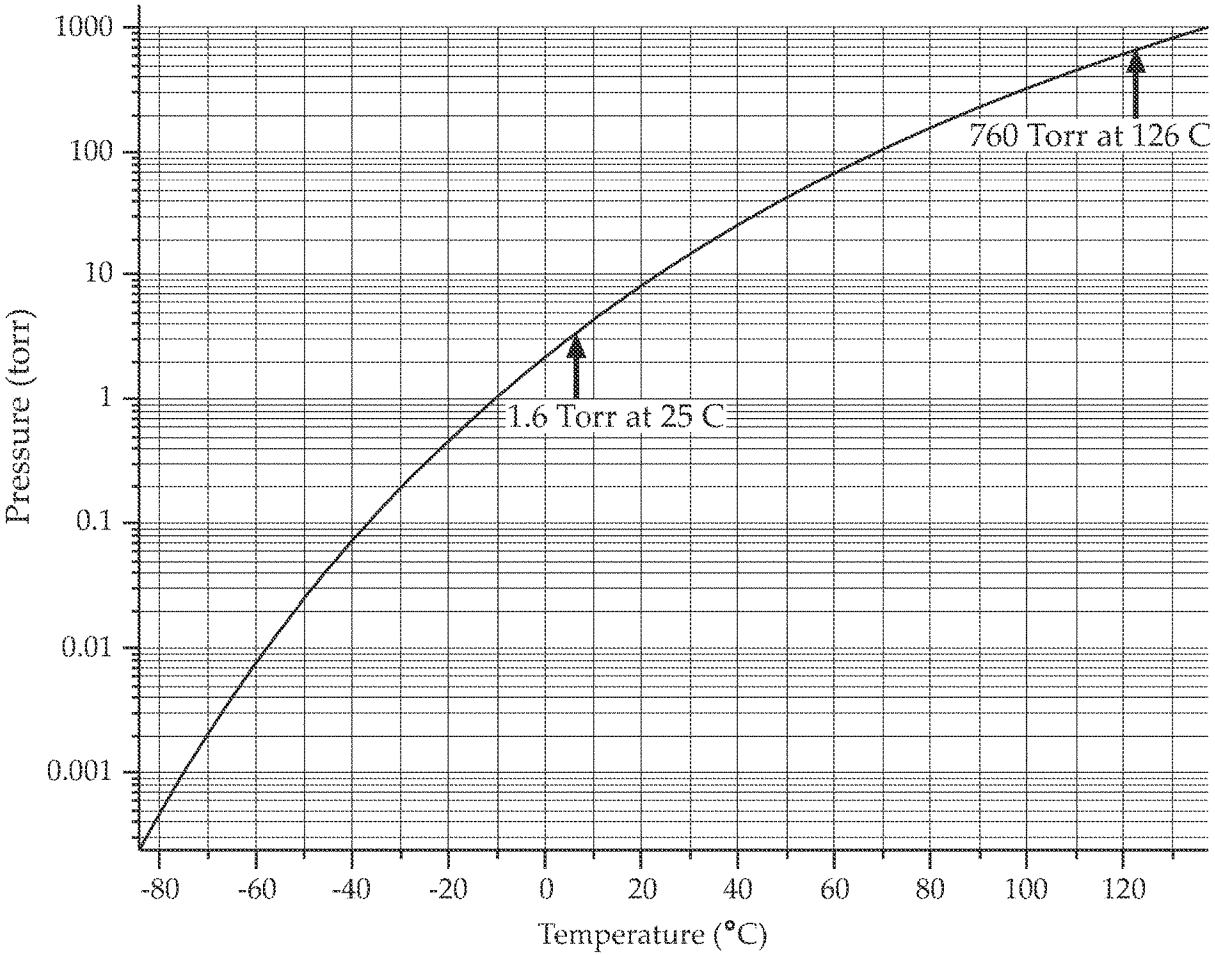
FIG. 4B illustrates the dependency of vapor pressure on temperature for butyl acetate.

FIGS. 4A and 4B illustrate schematically the dependency of vapor pressure of ethyl acetate and butyl acetate, respectively, on temperature, the graphs show that even a 5 degrees rise in temperature around room temperature, increases the vapor pressure of the solvents by about 50%, initiating, in some working conditions, about 30%, about 40% and even close to about 50% increase in the rate of evaporation.

Recent technological progress in Light Emitting Diode (LED) technology enables providing of LEDs in the IR range that may be employed for radiating in a selective spectral range that corresponds to an absorption peak of a solvent. For example, LEDs which are configured to radiate in the range of 1.9 um to 7 um are provided by Boston Electronics Corporation (http://boselec.com/products/irled.html). Employing a LED configured to radiate in a defined spectrum that corresponds to an absorption peak of the solvent may be exemplified as follows.

Figure 5B:
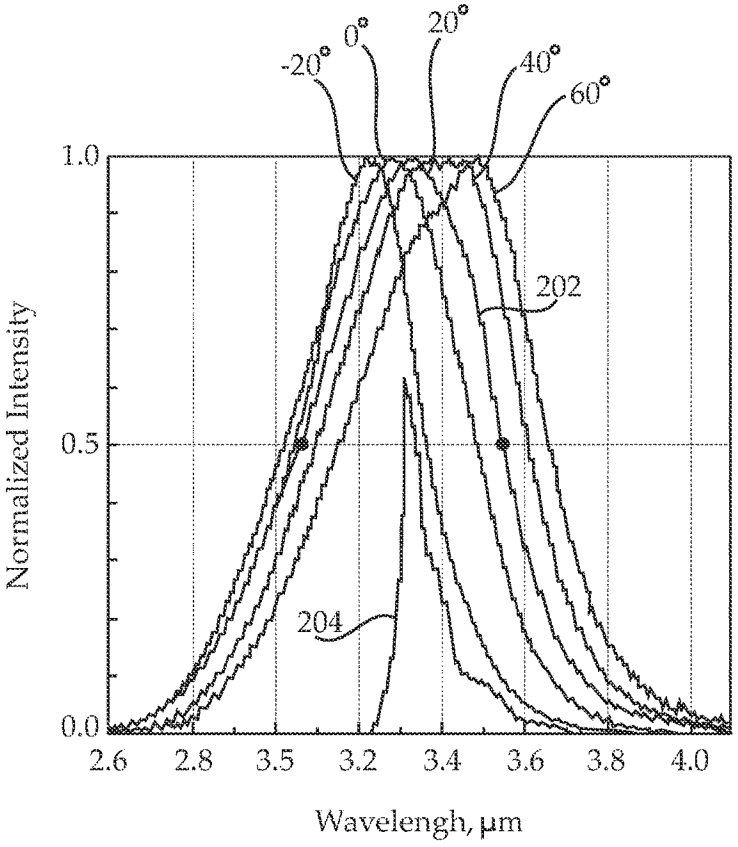
FIG. 5B illustrates the radiation spectrum of LEDs configured to radiate at a wavelength of about 3,350 nm.

Attention is now drawn to FIG. 1, FIG. 2 and FIGS. 5A and 5B together. The absorption spectra of both ethyl acetate and butyl acetate have an absorption peak around 3000 cm−1, namely absorption peaks 16 and 56, in FIG. 1 and FIG. 2, respectively. FIG. 5B schematically illustrates spectral radiation curves of LED 34SC by Boston Electronics Corporation for several temperatures of the LED's junction. Radiation curve 202 at 20 Deg. C., peaks at a wavelength of about 3350 nm, and may thus be selected to be employed in radiating nail lacquer comprising nitrocellulose as film former and ethyl acetate and butyl acetate as solvents. Curve 204 in FIG. 5B illustrates schematically absorption peak 16 of ethyl acetate for comparison to radiation curve 202.

Curve 202 is further illustrated, within the spectral range defined by the half-maximum points thereof, on graph 20 in FIG. 1 and on graph 70 in FIG. 2 (on an arbitrary intensity scale). The spectral range of each of the absorption peaks of the solvents is about 10% of the radiation spectrum of the LED. Thus, about 10% of the power radiated by the LED is concentrated in the spectral range of each of the absorption peaks.

Figure 5A:
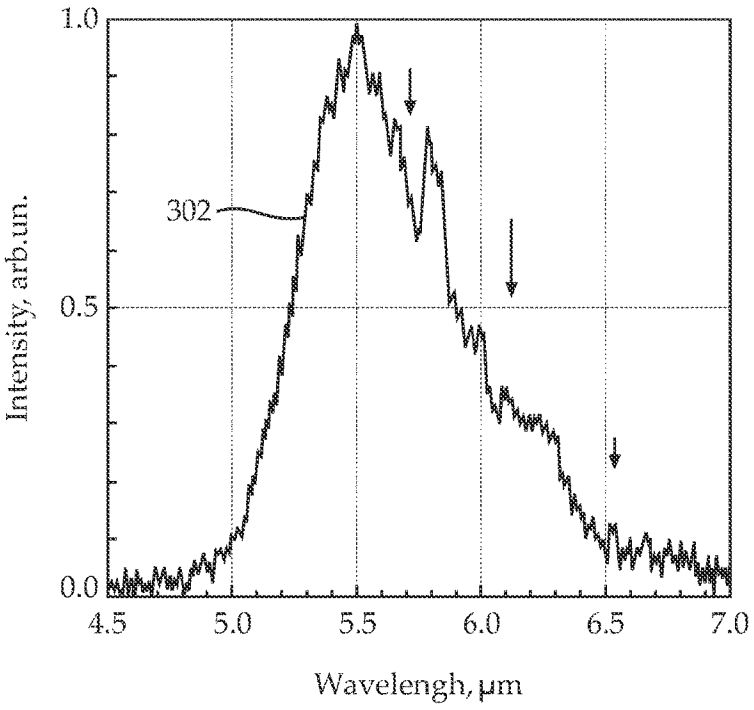
FIG. 5A illustrates the radiation spectrum of a LED configured to radiate at a wavelength of about 5,500 nm.
Figure 6:
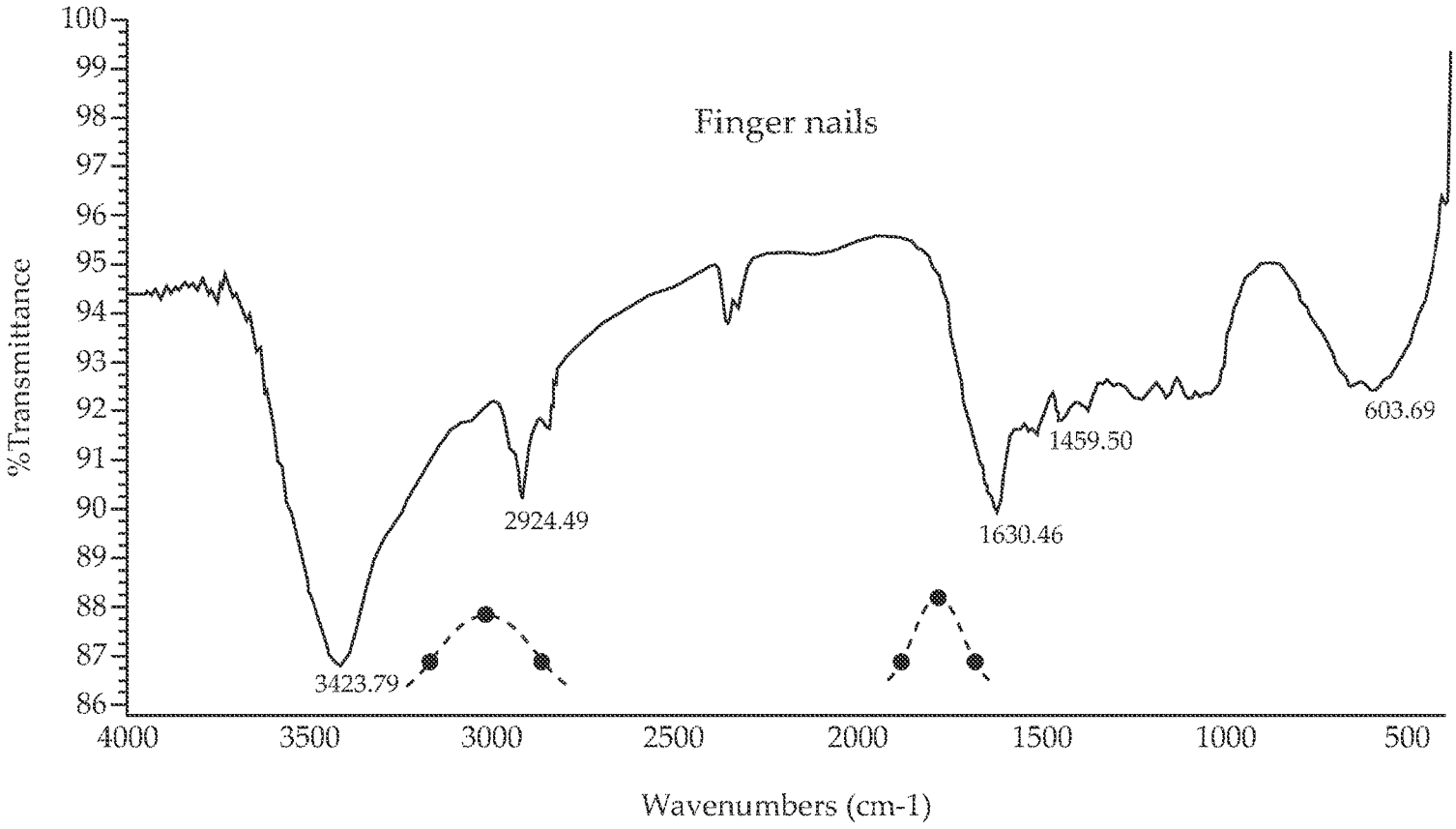
FIG. 6 illustrates an IR transmittance spectrum of fingernails.

Alternatively or additionally, the absorption peaks at about 1750 cm−1, associated with the C═O bond of the solvents, may be employed. FIG. 5A schematically illustrates a spectral radiation curve 302 of LED 55SC by Boston Electronics Corporation. Curve 302 is further illustrated, within the spectral range defined by the half-maximum points thereof, on graph 30 in FIG. 1 and on graph 60 in FIG. 2, depicting the C═O absorption peaks 14 and 54, respectively. The spectral range of each of the absorption peaks of the solvents is about 10% of the radiation spectrum of the LED. Thus, about 10% of the power radiated by the LED is concentrated in the spectral range of each of the absorption peaks.

Considering only the correlation of the radiation curves of the LEDs and the absorption peaks of the solvents as discussed above, may lead to preferring employing the C═O bond absorption peaks 14 and 54, and a LED such as 55SC described above as a radiation source, because the C═O absorption peak is stronger by about a factor of two, leading to higher absorption within the peak spectral range. According to some embodiments of the method, additional consideration may be employed. According to some embodiments, absorption spectra of other constituents of the coating, and particularly the absorption spectrum of the film former, may be considered. Attention is drawn back to FIG. 3 illustrating the absorption spectrum of nitrocellulose. Radiation curves 202 and 302 are schematically illustrated (on an arbitrary amplitude scale) on the graph for comparing the spectral correlation of the radiation curves with the absorption peaks of nitrocellulose. Radiation peak 202 overlaps with absorption peak 108, generating an average absorption of the nitrocellulose over the radiation spectrum of about 15%. Radiation peak 302 partially overlaps with absorption peak 104, generating an average absorption of the nitrocellulose over the associated radiation spectrum of about 20%. Thus, the elevated absorption of the solvents when employing LED 55SC at about 1750 cm−1, may be moderated by the increased absorption of the nitrocellulose in the same spectral range. A selection of a preferred radiation source and/or defined spectrum of radiation may thus be accomplished by comparing the total budget of absorption in the solvents to the absorption in the nitrocellulose according to the exact correlation between the absorption peaks and the associated radiation curves, as described above.

According to some embodiments, a radiation source such a LED may be modulated to further increase the efficiency of heating and evaporating a solvent. Pulse radiation may be advantageous because of two reasons. First, a short pulse may be employed to heat solvent molecules over a time period which is shorter than heat diffusion time from a solvent molecule to neighboring molecules. Thus, solvent molecules may be selectively heated by radiating the coating at an absorption spectral range of the solvent, over short time periods. Pulse power is regulated to be strong enough to ensure evaporation of a pre-selected percentage of solvent molecules that absorb the radiation during a single pulse. Evaporated molecules carry heat with them, thereby reducing total heat transfer to the film former and the substrate.

It is noted, that if the total energy of a single IR photon is transferred to heat of a single molecule such as an ethyl acetate molecule, the temperature of the molecule may rise by tens of degrees, and even by more than a hundred degrees. Thus, evaporation of solvent molecules from the surface of the coating may be tremendously increased, compared to prior art techniques. Consequently, the time for sufficient evaporation to allow drying is dictated by the rate of solvent molecules appearing on the surface, namely the diffusion rate of solvent molecules within the bulk of the coating. Employing a drying method that enables a drying time that is less dependent on the volatility of the solvent, as described herein according to some embodiments, may thus allow using solvents of relatively low volatility without sacrificing drying time, compared to using solvents of high volatility. Thus, according to some embodiments, methods described herein may contribute significantly to safety and environment-friendliness of coating processes in the industry.

A second advantage of employing modulation, and according to some embodiments employing pulse modulation in particular, is that some radiation sources may emit a higher peak power during a pulse, compared to an average power during continuous radiation. For example, LED 34SC introduced above, may radiate at a continuous power of 0.2 mWatt and at a pulse power of 0.5 mWatt in pulses as short as 20 nSec.

Thus employing a LED or a multitude of LEDs to enhance and accelerate solvent evaporation and hence coating drying may have three advantages from an energetic point of view: first, heat may directed, at least preferentially and in some embodiments even exclusively to solvent molecules, thereby avoiding or minimizing unnecessary heating of the other coating constituents and portions of the substrate, and consequently risk of overheating and/or damaging the substrate. Second, energy is saved, thereby enhancing process efficiency and reducing process cost. And third, using LEDs enables extremely fast light modulation of the light source e.g. by pulses. Modulating the light source may further increase process efficiency in some embodiments by further reducing average power supplied to the coated object and thereby reducing overall temperature elevation, without sacrificing drying time.

Figure 7:
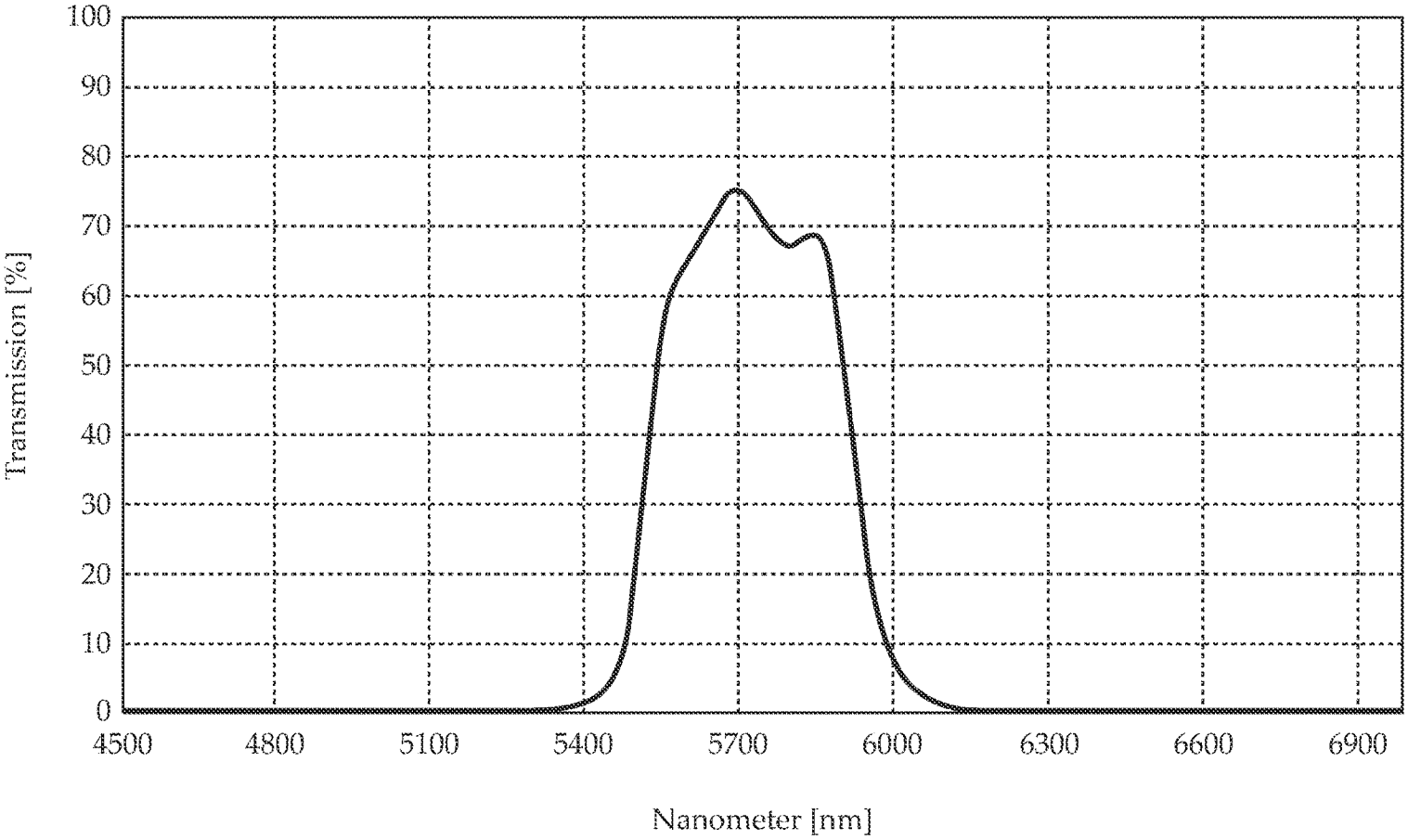
FIG. 7 illustrates a response curve of a band-pass filter in the IR range for defining a radiation spectrum according to some embodiments.

In some embodiments using LEDs may not be preferred or may not be possible, and a heating element generating substantially black body radiation, may be desired. According to some embodiments, a radiation source producing a wide spectrum radiation such as a black body radiation spectrum may be used, together with a spectral filter or spectral filters optically positioned between the radiation source and the coated object and configured to pass electromagnetic radiation in a defined spectrum corresponding to an absorption peak of the solvent. Although total energy may be saved to a considerable lesser extent, and may not be saved at all in some embodiments, compared to the prior art, such method is still advantageous in applications that benefit from selective heating of the solvent e.g. where heating the substrate is prohibited. FIG. 7 illustrates a response curve of an exemplary band-pass filter in the IR range, provided by Spectrogon (http://www.spectrogon.com/wp-content/uploads/spectrogon/BBP-5500-6000-nm.pdf). The response curve indicates a band pass permitting a defined spectrum of about 400 nm, between 5500 nm and 5900 nm. The defined spectrum by the spectral filter of FIG. 7 is even narrower than e.g. the defined spectra by the LEDs described above, and therefore may correspond well to a solvent's absorption peak at about e.g. 1700 $cm^{-1}$, such as a C═O bond absorption peak.

Some film forming agents, e.g., polymers, are known to have specific orientation upon the application of the coating to the substrate. While film-former chains are usually aligned in parallel to the substrate surface in a preferred direction, the spatial orientation of the solvent may be different than the orientation of the film-former. For example, upon uniaxial deformation of the polyacrylonitrile (PAN) films, dimethylformamide (DMF) solvent molecules exhibit preferential orientation with the transition moment of their C═O stretching vibration perpendicular to the direction of elongation [Siesler, Colloid & Polymer Sci. 255, 321-326 (1977)]. Vibration of the bonds aligned along the polymer chain will, therefore, interact best with resonant infrared radiation polarized in parallel to the direction of elongation and to the substrate surface. However, as the C═O stretching mode has a vector perpendicular to the polymer alignment direction, the C═O stretching mode will interact most efficiently with electromagnetic radiation which is polarized perpendicularly to the main plane of the coating surface.

Thus, according to some embodiments, the electromagnetic radiation is polarized. In further embodiments, the electromagnetic radiation is polarized in a direction of alignment of the solvent molecules polar bonds. In yet further embodiments, the electromagnetic radiation is polarized in a direction of alignment of the solvent molecules C═O bonds. In other embodiments, the electromagnetic radiation is polarized in a different direction than the direction of alignment of the film-former. In further embodiments, the electromagnetic radiation is polarized perpendicularly to the direction of alignment of the film-former. In still further embodiments, the electromagnetic radiation is polarized perpendicularly to the substrate surface.

In a first aspect, there is provided a method for drying a coating applied to a substrate, wherein the coating comprises at least one volatile organic solvent (VOS) having an absorption spectrum characterized by an average absorption and comprising a background portion and at least one absorption peak, characterized by a peak absorption at least about 1.5 times greater than the average absorption and further characterized by a peak width, wherein a combination of one or more peak widths define a peak spectral range, the method comprising a step of irradiating the coating by an electromagnetic radiation at a power P and within a defined spectrum, wherein said defined spectrum corresponds to said at least one absorption peak, so that at least a preselected percentage of P is spectrally concentrated within the peak spectral range.

According to some embodiments, the peak spectral range is defined by a spectral range between two points of half peak absorption. According to further embodiments, the peak spectral range is defined by a spectral range between two consecutive inflection points of said absorption spectrum.

According to some embodiments, the defined spectrum corresponds to said absorption peak, so that more than about 2% of P is spectrally concentrated within said spectral range of said absorption peak. According to further embodiments, the defined spectrum corresponds to said absorption peak, so that more than about 5% of P is spectrally concentrated within said spectral range of said absorption peak. According to still further embodiments, the defined spectrum corresponds to said absorption peak, so that more than about 10% of P is spectrally concentrated within said spectral range of said absorption peak. According to yet further embodiments, the defined spectrum corresponds to said absorption peak, so that more than about 20% of P is spectrally concentrated within said spectral range of said absorption peak. According to still further embodiments, the defined spectrum corresponds to said absorption peak, so that more than about 50% of P is spectrally concentrated within said spectral range of said absorption peak. According to yet further embodiments, the defined spectrum corresponds to said absorption peak, so that more than about 90% of P is spectrally concentrated within said spectral range of said absorption peak. According to still further embodiments, the defined spectrum corresponds to said absorption peak, so that more than about 99% of P is spectrally concentrated within said spectral range of said absorption peak. According to yet further embodiments, the defined spectrum corresponds to said absorption peak, so that more than about 99.9% of P is spectrally concentrated within said spectral range of said absorption peak.

In a second aspect, there is provided a method for drying a coating applied to a substrate, wherein the coating comprises at least one volatile organic solvent (VOS) having an absorption spectrum characterized by an average absorption and comprising a background portion and an absorption peak characterized by a peak absorption at least about 1.5 times greater than said average absorption and further characterized by a peak width wherein a combination of one or more peak widths defines a peak spectral range, the method comprising a step of irradiating the coating by an electromagnetic radiation at a power P and within a defined spectrum, wherein said defined spectrum corresponds to said at least one absorption peak, so that more than 2% of P is spectrally concentrated within said peak spectral range.

In a third aspect, there is provided a method for drying a coating applied to a substrate, wherein the coating comprises at least one volatile organic solvent (VOS) having an absorption spectrum characterized by an average absorption and comprising a background portion and at least one absorption peak characterized by peak absorption at least about 1.5 times greater than said average absorption and further characterized by a peak width wherein a combination of one or more peak widths defines a peak spectral range, the method comprising a step of irradiating the coating by an electromagnetic radiation at a power P and within a defined spectrum, wherein said defined spectrum corresponds to said at least one absorption peak, so that the peak spectral range at half height constitutes at least 20% of the defined radiation spectrum. According to some embodiments, the peak spectral range at half height constitutes at least 30% of the defined radiation spectrum. According to further embodiments, the peak spectral range at half height constitutes at least 40% of the defined radiation spectrum. According to still further embodiments, the peak spectral range at half height constitutes at least 50% of the defined radiation spectrum. According to yet further embodiments, the peak spectral range at half height constitutes at least 60% of the defined radiation spectrum. According to still further embodiments, the peak spectral range at half height constitutes at least 70% of the defined radiation spectrum. According to yet further embodiments, the peak spectral range at half height constitutes at least 80% of the defined radiation spectrum. According to still further embodiments, the peak spectral range at half height constitutes at least 90% of the defined radiation spectrum. According to yet further embodiments, the peak spectral range at half height constitutes at least 99% of the defined radiation spectrum. According to still further embodiments, the peak spectral range at half height constitutes at least 99.9% of the defined radiation spectrum.

According to some embodiments, the background portion is spectrally continuous. According to further embodiments, the absorption spectrum is in the Infra-Red (IR) range. According to additional embodiments, the peak absorption is at least 2 times greater than said average absorption. According to other embodiments, the peak absorption is at least 5 times greater than said average absorption.

The term "volatile organic solvent", as used herein, refers to hydrocarbon compounds or dimethicone compounds that have boiling points below 150° C., preferably below 125° C., more preferably below 100° C. Each possibility represents a separate embodiment of the invention. In some embodiments, the volatile organic solvent has boiling temperature above 150° C.

According to some embodiments, the at least one volatile organic solvent comprises a plurality of absorption peaks, such as one (1), two (2), three (3), four (4), five (5), or more peaks, and the defined spectrum corresponds to at least one of the plurality of the absorption peaks. According to other embodiments, the at least one volatile organic solvent comprises a plurality of absorption peaks, such as one (1), two (2), three (3), four (4), five (5), or more peaks, and the defined spectrum corresponds to the plurality of the absorption peaks.

According to some embodiments of the invention, the electromagnetic radiation is selectively absorbed by the at least one volatile organic solvent of the coating. According to further embodiments, the electromagnetic radiation is not absorbed by the substrate. According to still further embodiments, the electromagnetic radiation absorbed by the at least one volatile organic solvent, is configured to facilitate selective heating of the at least one volatile organic solvent. According to yet further embodiments, the electromagnetic radiation absorbed by the at least one volatile organic solvent, is configured to facilitate evaporation of the at least one volatile organic solvent.

According to some embodiments, the volatile organic solvent has a molecular vibrational frequency in the infrared spectral range. According to certain embodiments, the at least one absorption peak of the at least one volatile organic solvent is a molecular vibrational peak. According to further embodiments, the electromagnetic radiation, absorbed by the at least one volatile organic solvent, is translated to vibrational energy of the at least one organic volatile compound. According to certain embodiments, the defined spectrum corresponds to C═O bond vibration band of the at least one volatile organic solvent.

According to some embodiments, the bandwidth of the defined spectrum of the radiated power is about 1000 nm. According to some embodiments, the bandwidth of the defined spectrum of the radiated power is about 100 nm. According to some embodiments, the bandwidth of the defined spectrum of the radiated power is about 10 nm.

According to some embodiments, the volatile organic solvent is selected from the group consisting of alcohols, esters, ketones, aldehydes, ethers, aromatic hydrocarbons, and combinations thereof. Each possibility represents a separate embodiment of the invention. According to further embodiments, the volatile organic solvent is selected from the group consisting of acetone, ethyl acetate, butyl acetate, ethyl alcohol, butyl alcohol, methyl alcohol, isopropyl alcohol, methyl ethyl ketone, toluene, xylene, and combinations thereof. Each possibility represents a separate embodiment of the invention. According to some embodiments, the coating comprises at least one non-volatile compound. According to further embodiments, the electromagnetic radiation is not absorbed by the at least one non-volatile compound.

According to some embodiments the method is useful for drying decorative and/or functional coatings. According to further embodiments, the coating comprises lacquer, varnish, enamel, paint, polymeric coating, metal coating, adhesive or glue. According to certain embodiments, the lacquer comprises nail polish.

According to some embodiments, the method is configured to facilitate drying of the coating of thickness from about 0.05 μm to about 1 mm, more specifically, from about 0.1 μm to about 0.05 mm, from about 0.5 μm to about 1 mm, from about 1 μm to about 500 μm, from about 5 μm to about 100 μm, or from about 10 μm to about 50 μm.

According to further embodiments, the method is useful for drying a coating comprising a plurality of layers. According to some embodiments, the layers have similar coating composition. According to some embodiments, the electromagnetic radiation is absorbed by the plurality of layers. According to other embodiments, the electromagnetic radiation is absorbed by layers, having similar coating composition. According to certain embodiments, the method of the present invention does not require application of additional method-specific coating.

According to some embodiments, the method of the present invention further comprises a step of applying an electromagnetic radiation source for producing an electromagnetic radiation. The spectral range of the electromagnetic radiation source may be controlled by the temperature of the radiation source. According to some embodiments, the defined spectrum is not a black body radiation spectrum. According to further embodiments, the electromagnetic radiation in a defined spectrum is obtained from at least one Light Emitting Diode (LED). According to some embodiments, the at least one LED is configured to provide electromagnetic radiation in a defined spectrum, wherein the defined spectrum corresponds to the at least one absorption peak of the at least one volatile organic solvent of the coating. According to some embodiments, the method comprises providing a plurality of LEDs, wherein each LED is configured to provide electromagnetic radiation in a defined spectrum, wherein the defined spectrum corresponds to each of the plurality of the absorption peaks of the at least one volatile organic solvent of the coating. According to further embodiments, the electromagnetic radiation source from each of the plurality of LEDs is provided at different time and/or at different intensities. Each possibility represents a separate embodiment of the invention.

Another advantage of using LEDs as a radiation source in the method of the present invention is high efficiency of conversion of power to electromagnetic radiation in a defined spectrum, which allows to prevent excessive heating of the radiation source and of the surrounding thereof.

According to some embodiments, the electromagnetic radiation source is substantially a black body. According to further embodiments, the electromagnetic radiation in a defined spectrum is obtained from the electromagnetic radiation by filtering source. According to some embodiments, the defined spectrum obtained from the electromagnetic radiation source by filtering, corresponding to a plurality of absorption peaks of the at least one volatile compound. Adjusting the filter transmitting bandwidth to the solvent absorption band allows refining the infrared radiation spectrum to provide a substantially narrow (defined) and solvent-specific radiation even from a black-body radiation source.

According to some embodiments, the radiation source is configured to provide electromagnetic radiation of controllable intensity. According to further embodiments, the electromagnetic radiation is provided in a continuous intensity form. According to other embodiments, the electromagnetic radiation is temporally modulated by pulses. According to further embodiments, each pulse width is less than about 10 msec. According to still further embodiments, each pulse width is less than about 1 msec. According to yet further embodiments, each pulse width is less than about 100 usec. According to still further embodiments, each pulse width is less than about 10 usec. According to yet further embodiments, each pulse width is less than about 1 usec. According to still further embodiments, each pulse width is less than about 100 nsec. According to yet further embodiments, each pulse width is less than about 10 nsec. According to still further embodiments, each pulse width is less than about 1 nsec.

According to further embodiments, the pulses duty cycle is less than 10%. According to still further embodiments, the pulses duty cycle is less than 1%. According to yet further embodiments, the pulses duty cycle is less than 0.1%.

According to some embodiments, the method comprises a preceding step of analyzing an absorption spectrum of the at least one volatile organic solvent of the coating. According to further embodiments, the method further comprises a step of measuring absorption of the electromagnetic radiation by the coating. According to additional embodiments, the method further comprises a step of adjusting the defined spectrum of electromagnetic radiation in accordance with the measured absorbance. According to some embodiments, the adjustment of the radiation spectrum is performed manually by adjusting the radiation spectrum bandwidth to the evaluated absorption band of the coating. According to other embodiments, the adjustment is performed automatically, by providing solvent system composition or coating type to the device.

According to some embodiments, the method further comprises repeating a step of measuring absorption of the electromagnetic radiation by the coating, following the step of irradiating the coating. According to further embodiments, the method further comprises a step of adjusting the electromagnetic radiation spectrum in accordance with the measured absorbance. According to still further embodiments, the method further comprises a step of adjusting the electromagnetic radiation intensity in accordance with the measured absorbance. According to yet further embodiments, the method further comprises a step of adjusting the electromagnetic radiation pulse width in accordance with the measured absorbance. According to still further embodiments, the method further comprises a step of adjusting the electromagnetic radiation pulse duty cycle in accordance with the measured absorbance.

According to some embodiments, the method comprises a preceding step of analyzing an absorption spectrum of a non-volatile constituent of the coating, such as a film former. According to further embodiments, the method further comprises a step of measuring absorption of the electromagnetic radiation by the non-volatile constituent. According to additional embodiments, the method further comprises a step of adjusting the defined spectrum of electromagnetic radiation in accordance with the measured absorbance.

In a fourth aspect, the present invention provides a device for drying a coating applied to a substrate, wherein the coating comprises at least one volatile organic solvent (VOS) having an absorption spectrum characterized by an average absorption and comprising a background portion and an absorption peak characterized by a peak absorption at least about 1.5 times greater than said average absorption and further characterized by a peak width, wherein the device comprises an electromagnetic radiation source configured to radiate at a power P and within a defined spectrum, wherein said defined spectrum corresponds to the absorption peak, so that more than 5% of P is spectrally concentrated within said peak width.

According to some embodiments, the radiation source is further configured to irradiate the coating at a defined angle relative to the coating surface. According to some embodiments, the radiation source comprises a plurality of LEDs, wherein each of the plurality of LEDs is configured to irradiate the coating at a distinct angle.

According to some embodiments, the electromagnetic radiation is polarized.

According to further embodiments, the coating drying device comprises an enclosure, configured to accommodate the coating-comprising substrate. According to further embodiments, the device comprises a module, configured to control pressure within the enclosure by drawing air from within the enclosure.

According to some embodiments, the device is portable. Portable devices can be beneficially used for nail polish drying. According to other embodiments, the device is stationery. Stationery devices can be beneficially used for paint drying, for example for paint drying of automotive parts.

While a number of exemplary aspects and embodiments have been discussed above, those of skill in the art will recognize certain modifications, permutations, additions and sub-combinations thereof. It is therefore intended that the following appended claims and claims hereafter introduced be interpreted to include all such modifications, permutations, additions and sub-combinations as are within their true spirit and scope.

In the description and claims of the application, each of the words "comprise" "include" and "have", and forms thereof, are not necessarily limited to members in a list with which the words may be associated.

The invention claimed is:

1. A method for drying a nail polish applied to a fingernail, the nail polish including at least one volatile organic solvent (VOS) and at least one non-volatile compound, the VOS having one or more absorption peaks in the Infra-Red (IR) range, the method comprising evaporating the VOS by an electromagnetic radiation that selectively heats the VOS, wherein the electromagnetic radiation is in the range of 1,540 nm-20,000 nm and is substantially spectrally concentrated around the one or more absorption peaks, wherein the one or more absorption peaks are substantially distinct from absorption peaks of the non-volatile compound.

2. The method of claim 1, wherein the absorption peak is characterized by a peak absorption at least about 1.5 times greater than said average absorption.

3. The method of claim 1, wherein the electromagnetic radiation is in the range of 8,000 nm-15,000 nm.

4. The method of claim 1, wherein volatile organic solvent is selected from the group consisting of acetone, ethyl acetate, butyl acetate, ethyl alcohol, butyl alcohol, methyl alcohol, isopropyl alcohol, methyl ethyl ketone, toluene, xylene, and combinations thereof.

5. The method of claim 1, wherein the VOS comprises 10% to 60% by weight of the nail polish.

6. A device for drying a nail polish applied to a fingernail, the nail polish including at least one volatile organic solvent (VOS) and at least one non-volatile compound, the VOS having one or more absorption peaks in the Infra-Red (IR) range, the device comprising an electromagnetic radiation source configured to radiate an electromagnetic radiation at a wavelength in the range of 1,540 nm-20,000 nm and is substantially spectrally concentrated around the one or more absorption peaks, wherein the one or more absorption peaks are substantially distinct from absorption peaks of the non-volatile compound, thereby evaporating the VOS by selective heating thereof.

7. The device of claim 6, wherein the electromagnetic radiation is in the range of 8,000 nm-15,000 nm.

8. The device of claim 6, wherein volatile organic solvent is selected from the group consisting of acetone, ethyl acetate, butyl acetate, ethyl alcohol, butyl alcohol, methyl alcohol, isopropyl alcohol, methyl ethyl ketone, toluene, xylene, and combinations thereof.

9. The device of claim 6, wherein the VOS comprises 10% to 60% by weight of the nail polish.

10. The device of claim 6, wherein the device is portable.

* * * * *